US005468349A

United States Patent [19]

Schiel

[11] Patent Number: 5,468,349

[45] Date of Patent: Nov. 21, 1995

[54] PAPER MACHINE WIRE AND PRESSING SECTIONS WITH IMPERVIOUS PRESSING BELT

[75] Inventor: Christian Schiel, Heidenheim, Germany

[73] Assignee: J. M. Voith GmbH, Heidenheim, Germany

[21] Appl. No.: 261,831

[22] Filed: Jun. 17, 1994

[30] Foreign Application Priority Data

Jun. 26, 1993 [DE] Germany ..... 43 21 406.1

[51] Int. Cl.[6] ..... D21F 3/04

[52] U.S. Cl. ..... 162/358.3; 162/306; 162/360.2; 162/360.3

[58] Field of Search ..... 162/358.2, 358.3, 162/360.2, 360.3, 306

[56] References Cited

U.S. PATENT DOCUMENTS

| | | | |
|---|---|---|---|
| 4,173,249 | 11/1979 | Holkko et al. | 162/358.3 |
| 4,440,598 | 4/1984 | Koski et al. | 162/305 |
| 4,483,745 | 11/1984 | Wicks et al. | 162/205 |
| 4,526,655 | 7/1985 | Karvinen et al. | 162/360.2 |
| 4,976,821 | 12/1990 | Laapotti | 162/358.3 |
| 5,178,732 | 1/1993 | Steiner et al. | 162/358.3 |
| 5,240,563 | 8/1993 | Karvinen et al. | 162/358.2 |
| 5,298,124 | 3/1994 | Eklund et al. | 162/358.2 |

FOREIGN PATENT DOCUMENTS

| | | | |
|---|---|---|---|
| 3415457 | 11/1984 | Germany | 162/358.2 |
| 4224730 | 9/1993 | Germany | 162/360.2 |

*Primary Examiner*—Karen M. Hastings
*Attorney, Agent, or Firm*—Marshall, O'Toole, Gerstein, Murray & Borun

[57] ABSTRACT

A wet portion of a paper machine, including a wire section and a pressing section has a plurality of roll presses. Each roll press includes two rolls defining a press nip. A water impervious belt having a smooth, non-porous surface is disposed in a continuous loop about at least two roll press rolls disposed consecutively with respect to a direction of conveyance of a paper web through the machine. Each press roll is associated with at least one counter roll or one shoe roll defining first and second press nips of the pressing section. The belt deflects about 180° about each of the press rolls.

5 Claims, 2 Drawing Sheets

FIG. 1
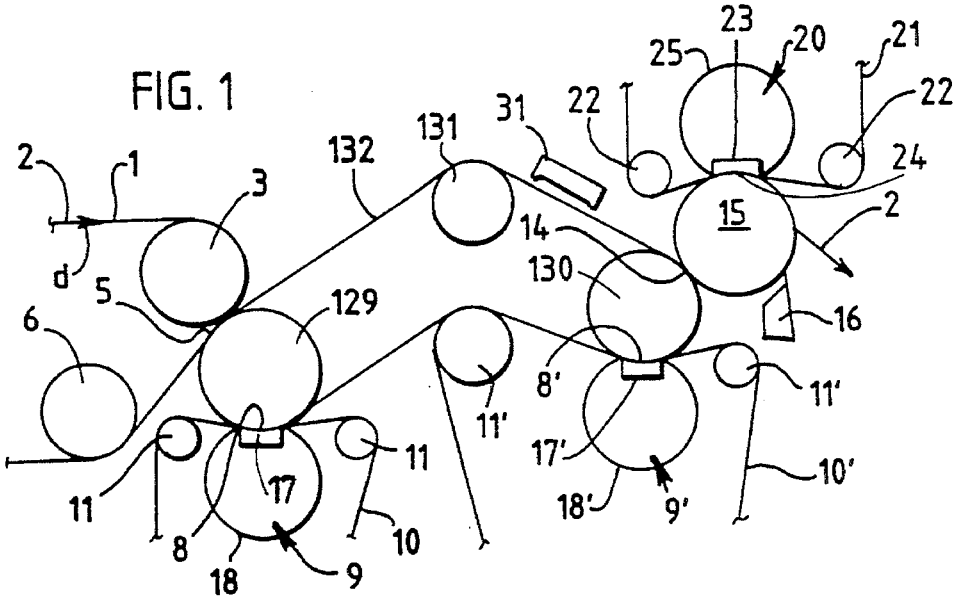
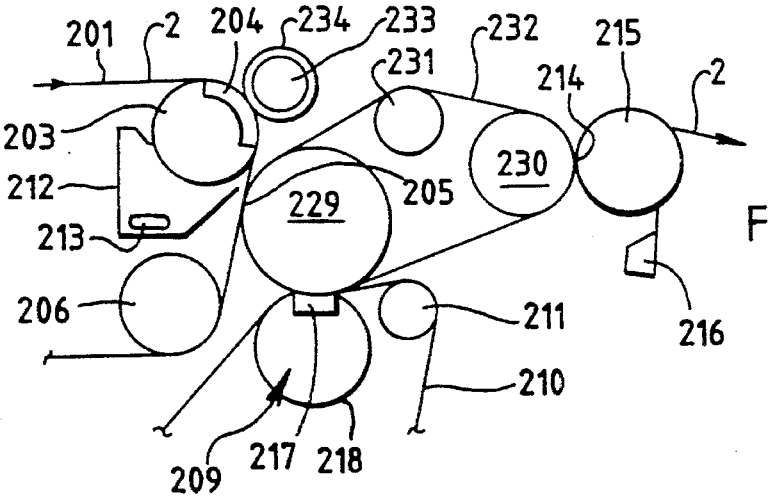
FIG. 2
FIG. 3
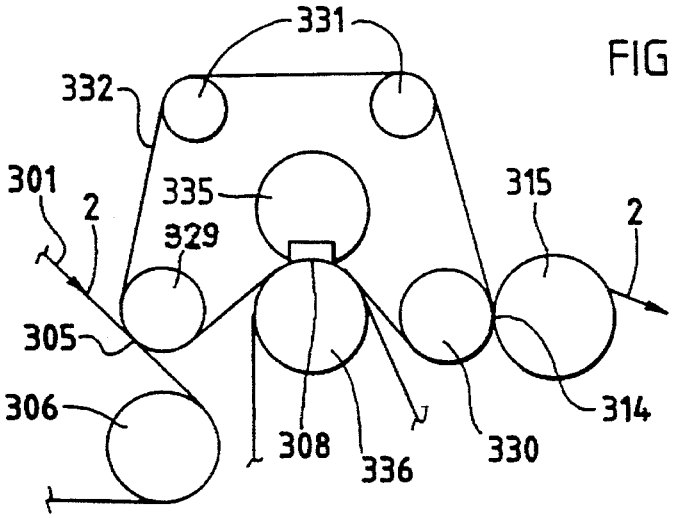

PAPER MACHINE WIRE AND PRESSING SECTIONS WITH IMPERVIOUS PRESSING BELT

BACKGROUND OF THE INVENTION

Field of the Invention

The invention relates to devices for forming fiber webs and in particular to a wet portion of a paper machine.

Description of Related Technology

A wet portion of a paper machine having a wire section and a pressing section and a plurality of roll presses in the pressing section is known from the art. Typically, each roll press includes two rolls that define a press nip. Such a pressing section that also includes a water impervious belt disposed in a continuous loop about at least two consecutive rolls of the pressing section is known from Wicks, et al., U.S. Pat. No. 4,483,745. The water impervious belt has a smooth, closed surface. Specifically, according to FIG. 1 of the Wicks et al. patent, two two-roll presses are provided in a pressing section. One roll of the first roll press is disposed within a first felt loop and a roll of the second roll press is disposed within a second felt loop. The two other rolls of each of the two-roll presses are disposed within the water impervious belt.

It would be advantageous for such a pressing section to meet the following requirements: The paper web produced on such a pressing section should reach as high a dry content as possible. There should be only minor differences in the properties of the paper web on its two sides. Furthermore, the cost of manufacturing and the wear of press felts and the water impervious belt disposed in the pressing section should be as low as possible. Finally, the paper web should have at most, only slight press felt markings after leaving the wet portion of the machine. The pressing sections known in the art at best only partially fulfill these requirements.

SUMMARY OF THE INVENTION

It is an object of the invention to overcome one or more of the problems described above. It is also an object of the invention to provide wire and pressing sections of a paper machine that produce optimal paper dewatering. It is also an object of the invention to provide a wet portion of a paper machine which produces a paper web exhibiting only minor differences in properties with respect to its two sides. It is a further object of the invention to provide a wet portion of a paper machine wherein the manufacturing costs and the wear of the press felts are low and wherein only slight felt markings are evident on the paper web after the web leaves the wet portion of the paper machine. Further objects of the invention are to increase the quality of the pressing work, especially the pressing efficiency, to simplify the structure of the wet portion of the paper machine and to reduce the danger of tearing of a paper web being conveyed through the wet portion of the machine.

According to the invention, a wet portion of a paper machine includes a wire section and a pressing section. A plurality of roll presses are disposed in the pressing section, each roll press including two rolls defining a press nip. A water impervious belt having a smooth, non-porous surface is disposed in a continuous loop about at least two press rolls disposed consecutively with respect to a direction of conveyance of a paper web through the machine. Each press roll is associated with at least one counter roll or one shoe roll defining first and second press nips of the pressing section. The belt deflects at least about 90° about at least one of the press rolls.

Other objects and advantages of the invention will be apparent to those skilled in the art from the following detailed description taken in conjunction with the drawings and the appended claims.

BRIEF DESCRIPTION OF THE DRAWINGS

FIG. 1 is a schematic view of a device according to the invention.

FIG. 2 is a schematic view of a second embodiment of a device according to the invention.

FIG. 3 is a schematic view of a third embodiment of a device according to the invention.

DETAILED DESCRIPTION OF THE INVENTION

Figure 4:
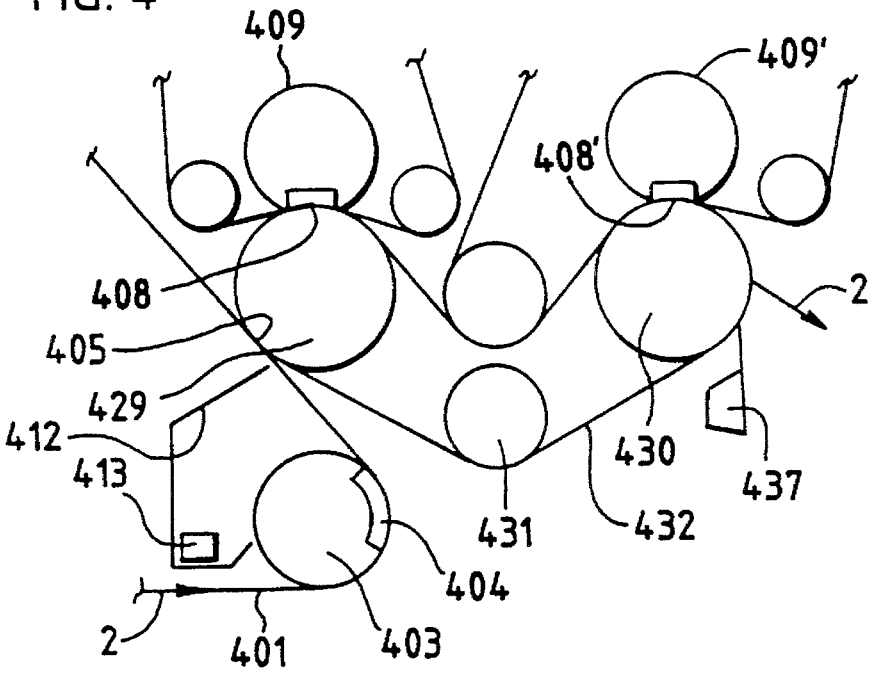
FIG. 4 is a schematic view of a fourth embodiment of a device according to the invention.

With reference to FIG. 1, a device according to the invention is shown having a wire 1 of a wire section shown moving in a direction indicated by an arrow d. The device includes guide rolls 3 and 6. A substantially water-impervious press belt 132 having a non-porous, smooth surface is looped about press rolls 129 and 130, and a guide roll 131. The belt 132 also bears against a guide roll 11'.

The device shown in FIG. 1 shows three roll presses cooperating with the belt 132. A first roll press disposed directly downstream of the wire section 1 with respect to the direction of conveyance of a web through the device includes the press roll 129 and a shoe unit or shoe roll 9 which together define a press nip 8. The shoe roll 9 includes a shoe 17 and a water impervious sliding belt 18. A press felt 10 passes through the press nip 8 and loops around guide rolls 11.

A second roll press disposed downstream of the first roll press also includes a shoe press. The second roll press includes the press roll 130 and a cooperating shoe unit 9' which together define a press nip 8'. The shoe unit 9' includes a shoe 17' and a water impervious sliding belt 18'. A press felt 10' is looped about guide rolls 11' and passes through the press nip 8' of the second roll press.

A third roll press includes the press roll 130 and a press roll 15 which together define a press nip 14. A fourth roll press includes the press roll 15 and a shoe unit 20 which together define a press nip 24. The shoe unit 20 has a shoe 23 and an water impervious sliding belt 25. A third press felt 21 is looped around guide rolls 22 and passes through the fourth press nip 24. A doctor blade device 16 is disposed against a surface of the press roll 15. In the vicinity of the doctor blade device 16, a paper web 2 is removed from the surface of the press roll 15.

The path of the paper web 2 through the device shown in FIG. 1 is as follows:

First, the paper web 2 is formed in a wire section and conveyed on the wire 1 of the wire section about the guide roll 3. The web 2 is removed from the wire 1 by the belt 132 at a location 5. The web 2 is conveyed with the belt 132 around a portion of a periphery of the press roll 129 and then through the press nip 8. The web 2 adheres to a lower surface of the belt 132 and is conveyed with the belt about the first of the two guide rolls 11'. The web 2 is then consecutively conveyed through the press nip 8', the press nip 14, and finally the press nip 24.

In the embodiment of the invention shown in FIG. 1, the paper web 2 is directly removed from the wire 1 by the belt 132. The belt 132 is tightly wound about the two press rolls 129 and 130 due to the path the belt is required to travel about the guide rolls 11' and 131. The angle of wrap of the belt about each of the press rolls 129 and 130 (i.e. the angle of deflection of the belt caused by contact with the rolls 129 and 130) is about 180°.

An embodiment of a device according to the invention shown in FIG. 2 includes a wire section having a wire 201, a suction deflecting roll 203 with a suction zone 204, and a guide roll 206. A water discharge channel 212 having a discharge 213 is disposed below the suction deflecting roll 203.

A pressing section of the device of FIG. 2 shows two roll presses cooperating with a smooth, water-impervious belt 232 similar in design and function to the belt 132 described herein with respect to FIG. 1. The first roll press includes a press roll 229 which defines a press nip 208 with a shoe unit 209. The shoe unit 209 includes a shoe 217 and a water-impervious sliding belt 218. A press felt 210 loops about a guide roll 211 and passes through the press nip 208 of the first roll press.

The second roll press shown in FIG. 2 includes two press rolls 230 and 215 which together form a press nip 214. The press roll 215 has a closed (i.e. non-porous) surface. A doctor device 216 cooperates with the roll 215 making contact therewith and thereby ensuring that the surface of the roll 215 is kept clean. As shown in FIG. 2, a paper web 2 is removed from the device at the surface of the press roll 215.

The embodiment of a device according to the invention shown in FIG. 2 also shows a press roll 233 having a soft rubber coating 234 that cooperates with the suction deflecting roll 203. A paper web 2 conveyed through the device first passes between the roll 203 and the roll 233, then through the press nip 208, and then through the press nip 214.

The device shown in FIG. 2 is similar to the device shown in FIG. 1 in that it illustrates a device according to the invention wherein a paper web 2 is directly removed from a wire 201 of a wire section of the device by the water impervious belt 232. The closed, non-porous surface of the press roll 215 ensures smoothing of any felt marking on the paper web 2.

Another embodiment of a device according to the invention is shown in FIG. 3. The device of FIG. 3 includes two roll presses cooperating with a water impervious belt 332. The first roll press includes a press roll 336 and a shoe roll 335 defining a press nip 308. The second roll press includes a press roll 315 and a press roll 330 defining a roll nip 314. The belt 332 loops about the roll 335 and the roll 330, as well as about guide rolls 331 and 329. As with the embodiments shown in FIGS. 1 and 2, the water impervious belt 332 removes a paper web 2 directly off a wire 301 of a wire section of the device. The paper web 2 is conveyed through the press nip 308 and then the press nip 314. Because the press nip 314 is formed by the belt 132 and the press roll 315 which has a smooth, non-porous surface, any markings on the paper web 2 caused by contact between the moist paper web and a press felt disappears when the web 2 is conveyed through the press nip 314.

Another embodiment of a device according to the invention is shown in FIG. 4. The device of FIG. 4 includes two roll presses cooperating with a water impervious belt 432. The first roll press includes a press roll 429 and a shoe roll 409 defining a press nip 408. The second roll press includes a press roll 430 and a shoe roll 409' defining a roll nip 408'. The belt 432 loops about the roll 429 and the roll 430, as well as a guide roll 431. As with the embodiments shown in FIGS. 1, 2, and 3, the water impervious belt 432 removes a paper web 2 directly off a wire 401 of a wire section of the device. The elements 403, 404, 412, and 413 are similar in function to the elements 203, 204, 212, and 213, respectively, described herein with respect to FIG. 2.

Figure 5:
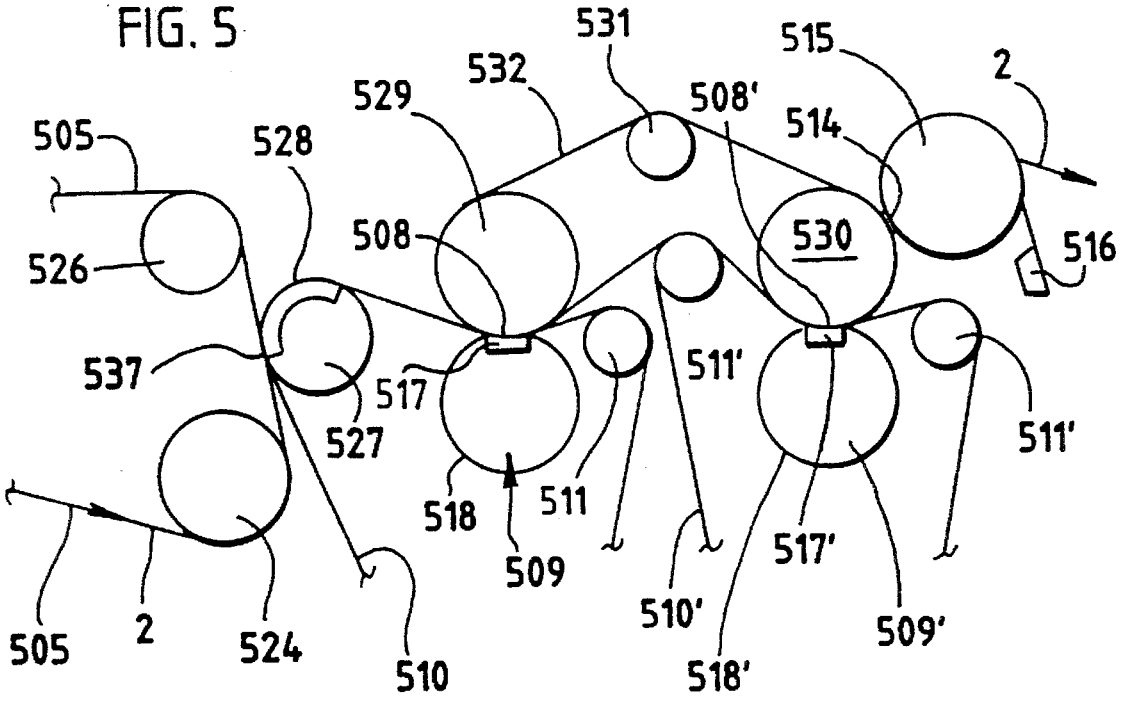
FIG. 5 is a schematic view of a fifth embodiment of a device according to the invention.

In an embodiment of a device according to the invention shown in FIG. 5, a paper web 2 is transferred from a wire 505 onto a first press felt 510 by a suction take-off roll 527 having a suction zone 528 about which the felt 510 loops. The press felt 510 and the web 2 then pass through a press nip 508 of a first roll press. The first roll press includes a press roll 529 and a shoe roll 509 having a shoe 517 and-a sliding belt 518. The rolls 529 and 509 together define the press nip 508. A second roll press includes a press roll 530 and a shoe roll 509' defining a roll nip 508'. The roll 509' has a shoe 517' and a sliding belt 518'. A smooth, water impervious belt 532 loops about the roll 529 and the roll 30, as well as a guide roll 531. Another press nip 514 is defined by the roll 530' and a roll 515 having a smooth, non-porous, surface against which a doctor blade device 516 is placed. The paper web 2 is conveyed consecutively though the roll nips 508, 508' and 514.

The foregoing detailed description is given for clearness of understanding only, and no unnecessary limitations should be understood therefrom, as modifications within the scope of the invention will be apparent to those skilled in the art.

I claim:

1. In a wet portion of a paper machine comprising a wire section and a pressing section, a plurality of roll presses in said pressing section, each roll press comprising two rolls defining a press nip, and a water impervious belt having a smooth closed surface, said belt being disposed in a continuous loop about at least first and second press rolls disposed consecutively with respect to a direction of conveyance of a paper web through the machine, each said press roll being coupled with a counter element defining first and second respective press nips of the pressing section, said counter element selected from the group consisting of shoe units and counter rolls, and wherein said belt deflects at least about 90° about at least one of the first and second press rolls, the improvement wherein the belt is disposed immediately downstream of the wire section with respect to the direction of conveyance of a paper web through the machine and arranged so that the belt directly removes a paper web from the wire section and further comprising means for guiding the belt about the first and second press rolls in such a way that the belt deflects at least about 180° about each of the press rolls.

2. The improvement of claim 1 wherein said first press nip is defined by said first press roll and a shoe unit.

3. The improvement of claim 2 wherein said shoe unit is disposed within the belt loop.

4. The improvement of claim 2, wherein the shoe unit is disposed outside of the belt loop.

5. The improvement of claim 2 wherein the second press nip is feltless and is formed by the second press roll and a counter roll having a non-porous surface.

* * * * *